US008469356B2

(12) United States Patent
Kweon

(10) Patent No.: US 8,469,356 B2
(45) Date of Patent: Jun. 25, 2013

(54) PAPER SUPPLY UNIT

(75) Inventor: Do Hyung Kweon, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 12/647,224

(22) Filed: Dec. 24, 2009

(65) Prior Publication Data

US 2010/0171259 A1 Jul. 8, 2010

(30) Foreign Application Priority Data

Jan. 5, 2009 (KR) ..... 10-2009-0000427

(51) Int. Cl.
*B65H 1/00* (2006.01)

(52) U.S. Cl.
USPC ..... 271/171; 271/145

(58) Field of Classification Search
USPC ..... 271/145, 171
See application file for complete search history.

(56) References Cited

U.S. PATENT DOCUMENTS 6,116,591 A * 9/2000 Kim ..... 271/171
6,830,245 B2 * 12/2004 Matsushima et al. ..... 271/171
6,871,848 B2 3/2005 Matsushima et al.
2003/0080497 A1 * 5/2003 Matsushima et al. ..... 271/171
2004/0135306 A1 * 7/2004 Takahashi ..... 271/145
2005/0062218 A1 * 3/2005 Murakami et al. ..... 271/171
2007/0189822 A1 * 8/2007 Nakamura ..... 399/393
2009/0236796 A1 * 9/2009 Chino ..... 271/171
2010/0270735 A1 * 10/2010 Allwright et al. ..... 271/171
2011/0140352 A1 * 6/2011 Tanaka ..... 271/264

FOREIGN PATENT DOCUMENTS

JP 05-186059 7/1993

OTHER PUBLICATIONS

English language abstract of JP 05-186059, published Jul. 27, 1993.
Machine English language translation of JP 05-186059, published Jul. 27, 1993.

* cited by examiner

*Primary Examiner* — Patrick Cicchino
(74) *Attorney, Agent, or Firm* — Stanzione & Kim, LLP

(57) ABSTRACT

A paper supply unit includes one or more supporting members that are capable of moving between various positions to support an end portion of paper of various sizes, and which are moveable between the positions in association of the movement of a handle accessible to a user. A locking device is provided to maintain the handle selectively at one of the various positions so as to maintain the supporting members in the position suitable for supporting the paper of selected size. A guide plane may be provided to guide the movement of the handle. One or more indication marks indicating the corresponding positions of the handle for the selection of the paper size. The provision of the locking device at the handle may advantageously resulting in a simple configuration of the paper supply unit.

18 Claims, 10 Drawing Sheets

PAPER SUPPLY UNIT

CROSS-REFERENCE TO RELATED APPLICATION

This application claims the benefit of Korean Patent Application No. 2009-0000427, filed on Jan. 5, 2009 in the Korean Intellectual Property Office, the disclosure of which is incorporated herein by reference in its entirety.

TECHNICAL FIELD

The disclosure relates to a paper supply unit having a handle capable of moving supporting members that are used to support an end of paper in correspondence to a paper size.

BACKGROUND OF RELATED ART

A paper supply unit is generally designed to supply paper, and may be applied to or utilized in image forming apparatuses, such as printers, copiers, facsimiles, and the like, to supply paper used in the image forming apparatuses.

A conventional paper supply unit may include a paper supply unit housing having a paper reservoir in which paper is stored. The paper reservoir may include, for example, a knock-up plate on which paper is stacked, a lifting device to vertically move the knock-up plate, a plurality of supporting members to support ends of paper, the supporting members being moveable based on the paper size to allow various sizes of paper to be used in the paper reservoir and a supporting member drive device to move the plurality of supporting members.

The supporting member drive device may be configured to move the supporting members upon receiving an external force applied by a user. The supporting member drive device may include a handle moveable by an external force thus serving to move the supporting members. In such paper supply unit, the supporting members are provided with locking mechanisms to keep the supporting members at predetermined positions while the handle is provided with a lever to selectively release the locking mechanisms upon receiving the external force.

In the above-described conventional paper supply unit, although the lever and handle, to which the external force are applied, are arranged adjacent to an opening of the paper supply unit to allow the user to apply the external force to the lever and handle, the locking mechanisms provided at the supporting members that support an inner end of paper are located deep in the paper supply unit at a significant distance from the opening. Therefore, the locking mechanisms may have a need for a mechanisms to transmit the external force applied to the lever to the locking mechanisms, resulting in a complicated locking configuration. Thus, a paper supply unit with a simplified configuration and convenient operation is desired.

SUMMARY OF THE DISCLOSURE

In accordance with an embodiment, a paper supply unit may be provided to include at least one paper supporting member, a handle, a guide plane and a locking device. The at least one paper supporting member may be movably arranged to support an end portion of paper. The handle may be configured to receive an external force, and may be moveable in response to the received external force. The at least one supporting members may be moveable in association with a movement of the handle. The guide plane may be configured to guide the movement of the handle. The locking device may be provided at the handle, and may be configured to maintain the handle at a predetermined position in relation to the guide plane.

The locking device may comprises a latch that protrudes downward from the handle in a vertically movable manner. The guide plane may comprise a supporting groove into which a lower end of the latch is received.

The locking device may further comprise a lever and a return spring. The lever may be configured to rotate upon receiving the external force from an original position at which the latch is received in the supporting groove into a released position at which the latch is positioned out of the supporting groove. The return spring may be configured to elastically bias the lever toward a direction of returning to the original position.

The locking device may comprise an elastic supporting unit elastically supporting the handle on the guide plane in such a manner that the handle is moveable along the guide plane. The guide plane may comprise a plurality of alternatingly arranged peaks and valleys.

The elastic supporting unit may comprise a rolling member, an elastic supporting bracket and an elastic member. The rolling member may be rotatably supported on the guide plane. The rolling member may be rotatably mounted to the elastic supporting bracket. The elastic member may have a lower end supported by the elastic supporting bracket and an upper end supported by the handle.

The guide plane may extend to define an arc. The handle may be configured to move along the guide plane in a circumferential direction of the arc.

The handle may comprise a grip portion and a hinge portion. The external force may be applied to the grip portion. The hinge portion may extend from the grip portion, and may be pivotally coupled to the paper supply unit so as to allow a rotational movement of the handle.

The paper supply unit may further comprise a handle bracket comprising an indication plane, the indication plane being configured to cover an upper side of a rotation path of the hinge part and having thereon indication marks corresponding to a plurality of selectable paper sizes. The guide plane may be positioned radially outside of the indication plane with respect to the rotational movement of the handle.

The paper supply unit may further comprise a knock-up plate and a lifting device. The knock-up plate may have a surface onto which the paper is to be received. The lifting device may be configured to vertically move the knock-up plate.

The lifting device may comprise a lifting motor, a driving pulley, a driven pulley and a lifting belt. The lifting motor may be configured to produce a rotational force. The driving pulley may be arranged to received the rotational force from the lifting motor and to thereby rotate. The driven pulley may be arranged spaced apart from the driving pulley. The lifting belt may be supported on the driving pulley and the driven pulley, and may be coupled to the knock-up plate. The lifting belt may be rotatable by the rotation of the driving pulley so as to cause the knock-up plate to move vertically.

The at least one supporting member may comprise a first supporting member configured to support a longitudinal end of the paper and a pair of second supporting members configured to support both transversal ends of the paper. The paper supply unit may further comprise a supporting member drive device configured to move the first supporting member and the pair of second supporting members.

The supporting member drive device may comprise a driving pulley, a driven pulley, a moving belt and a rack gear. The driving pulley may cooperatively coupled with the handle so as to be rotatable by the movement of the handle. The driven pulley may be arranged to be spaced apart from the driving pulley. The moving belt may be supported on the driving pulley and the driven pulley, and may be rotatable by the driving pulley to thereby cause a rotation of the driven pulley. The rack gear may be coupled to the first supporting member, and may be movable linearly along a longitudinal direction by the rotation of the driven pulley.

The supporting member drive device may further comprise one or more linkage guides coupled to the first supporting member and configured to move the second supporting members in linkage with the first supporting member.

Each of the one or more linkage guides may comprise one or more linkage guide slots extending generally along the longitudinal direction of the paper with at least one change of direction along a transversal direction of paper. Each of the second supporting members may comprise one or more linkage guide protrusions configured to be received into a respective corresponding one of the one or more linkage guide slots.

According to another aspect of the present disclosure, a paper supply unit may be provided to comprise a supporting member, a guide plane, a handle and a locking device. The supporting member may be movably arranged to support an end portion of paper. The guide plane may define an arc shaped surface. The handle may be configured to move in response to an external force in a circumferential direction of the arc shaped surface of the guide plane while being guided on the arc shaped surface. The supporting members may be moveable in association with a movement of the handle. The locking device may be provided at the handle, and may be configured to maintain the handle at a predetermined position on the guide plane.

The locking device may comprise a latch, a lever, a return spring and a supporting groove. The latch may protrude downward from the handle in a vertically movable manner. The lever may be configured to rotate upon receiving the external force from an original position at which the latch is in a first position into a released position at which the latch has moved upward from the first position. The return spring may be configured to elastically bias the lever toward a direction returning to the original position. The supporting groove may be arranged on the guide plane in such a manner that a lower end of the latch is receivable into the supporting groove.

The locking device may comprises an elastic supporting unit elastically supporting the handle on the guide plane in such a manner that the handle is moveable along the guide plane. The guide plane may comprise a plurality of alternatingly arranged peaks and valleys.

According to yet another aspect of the present disclosure, a paper supply apparatus for receiving therein a supply of paper of variable sizes may be provided to comprise a handle, a supporting member and a locking mechanism. The handle may be arranged to be accessible from outside of the paper supply apparatus so as to be capable of receiving an external force, and may be configured to move in response to the external force selectively between at least a first handle position and a second handle position. The supporting member may be arranged to be movable in cooperation with a movement of the handle between at least a first support position and a second support position to support an end portion of paper of a first size and of a second size, respectively. The locking mechanism may be arranged adjacent the handle, and may be configured to maintain the handle at selected one of the first handle position and the second handle position.

The supporting member may comprise a first supporting member and a pair of second supporting members. The first supporting member may be configured to support a longitudinal end of paper. The pair of second supporting members may be configured to support transversal ends of paper. The paper supply apparatus may further comprise a supporting member drive device configured to move the first supporting member and the pair of second supporting members. The supporting member drive device may comprise a driving pulley, a driven pulley, a belt, a rack gear and one or more linkage guides. The driving pulley may be coupled to the handle so as to be rotatable by the movement of the handle. The driven pulley may be arranged to be spaced apart from the driving pulley. The belt may be supported on the driving pulley and the driven pulley so as to be rotatable by a rotation of the driving pulley. The rack gear may be configured to move along a longitudinal direction of paper in cooperation with the driven pulley. The first supporting member may be coupled to the rack gear so as to move together with the rack gear. The one or more linkage guides may be arranged between the first supporting member and the second supporting members so as to cause the second supporting members to move along a transversal direction of paper in linkage with the first supporting member.

The paper supply apparatus may further comprise a plurality of indication marks arranged adjacent the handle. Each of the plurality of indication marks may correspond to a respective corresponding one of the variable sizes of paper.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
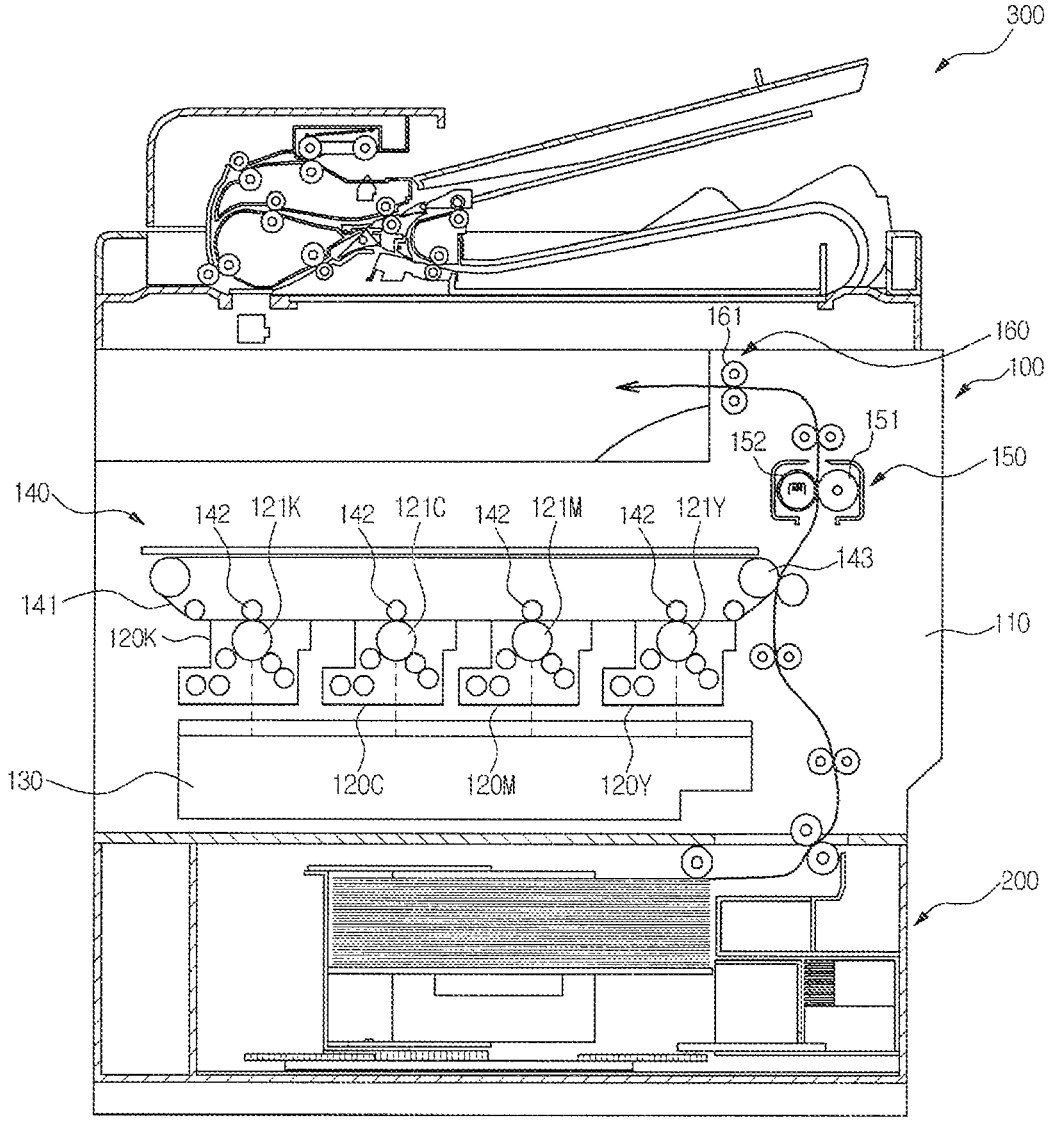
FIG. 1 is a sectional view illustrating an image forming apparatus and a paper supply unit according to one embodiment.

Reference will now be made in detail to the embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

With reference to FIG. 1, a paper supply unit 200 according to an embodiment may be provided separately from an image forming apparatus 100, and may be detachably coupled to the image forming apparatus 100, for example, at the bottom portion thereof, to supply paper to the image forming apparatus 100. An automatic document feeding unit 300 for automatic feeding of document(s) may be provided on the top of the image forming apparatus 100.

The image forming apparatus 100 may include a body 110 that defines an overall external appearance of the apparatus; a plurality of developing units 120K, 120C, 120M and 120Y configured to develop electrostatic latent images into visible images by the uses of developer; an exposure unit 130 configured to form the electrostatic latent images on photoconductors 121K, 121C, 121M and 121Y of the developing units 120K, 120C, 120M and 120Y; a transfer device 140 configured to transfer visible images formed on the photoconductors 121K, 121C, 121M and 121Y to paper or another medium; a fusing unit 150 configured to fuse the visible developer image to the paper; and a paper discharge unit 160 configured to discharge the paper bearing the visible images fused thereto outside of the body 110.

The developing units 120K, 120C, 120M and 120Y may be provided as image carriers containing developer images. The developing units 120K, 120C, 120M and 120Y may be configured to feed developer to the photoconductors 121K, 121C, 121M and 121Y, on surfaces of which electrostatic latent images are formed by the exposure unit 130, thus enabling formation of visible images using developer. In an embodiment, four developing units 120K, 120C, 120M and 120Y, in which black (K), cyan (C), magenta (M) and yellow (Y) developers are respectively received, may be provided, although there is no limit to the number of developing units, and fewer or more may be provided.

The exposure unit 130 may be configured to irradiate light containing image information to the photoconductors 121K, 121C, 121M and 121Y, to form electrostatic latent images on the surfaces of the photoconductors 121K, 121C, 121M and 121Y.

The transfer device 140 may include an intermediate transfer belt 141 configured to receive the visible images from the respective photoconductors 121K, 121C, 121M and 121Y. The transfer device 140 may further include first transfer rollers 142 arranged opposite the photoconductors 121K, 11C, 121M and 121Y with the intermediate transfer belt 141 interposed therebetween and configured to transfer the visible images of the photoconductors 121K, 121C, 121M and 121Y to the intermediate transfer belt 141. The transfer device 140 may additionally include a second transfer roller 143 configured to transfer the visible images of the intermediate transfer belt 141 to a sheet of paper or to other types of medium. Accordingly, the visible images formed on the photoconductors 121K, 121C, 121M and 121Y are transferred to the intermediate transfer belt 141 by the first transfer rollers 142, and, in turn, the visible images of the intermediate transfer belt 141 are transferred to a sheet of paper supplied from the paper supply unit 200 as the paper passes between the second transfer roller 143 and the intermediate transfer belt 141.

The fusing unit 150 may include a press roller 151, an outer peripheral surface of which may be made of an elastically deformable material, and a heating roller 152 arranged to move in contact with the outer peripheral surface of the press roller 151. The visible images that were transferred to the sheet of paper may become fused to the paper by the heat and pressure applied to the paper as the paper passes between the press roller 151 and the heating roller 152.

The paper discharge unit 160 may include a pair of paper discharge rollers 161 arranged in sequence and may be configured to discharge the sheet of paper that has passed through the fusing unit 150 outside of the body 110.

Figure 2:
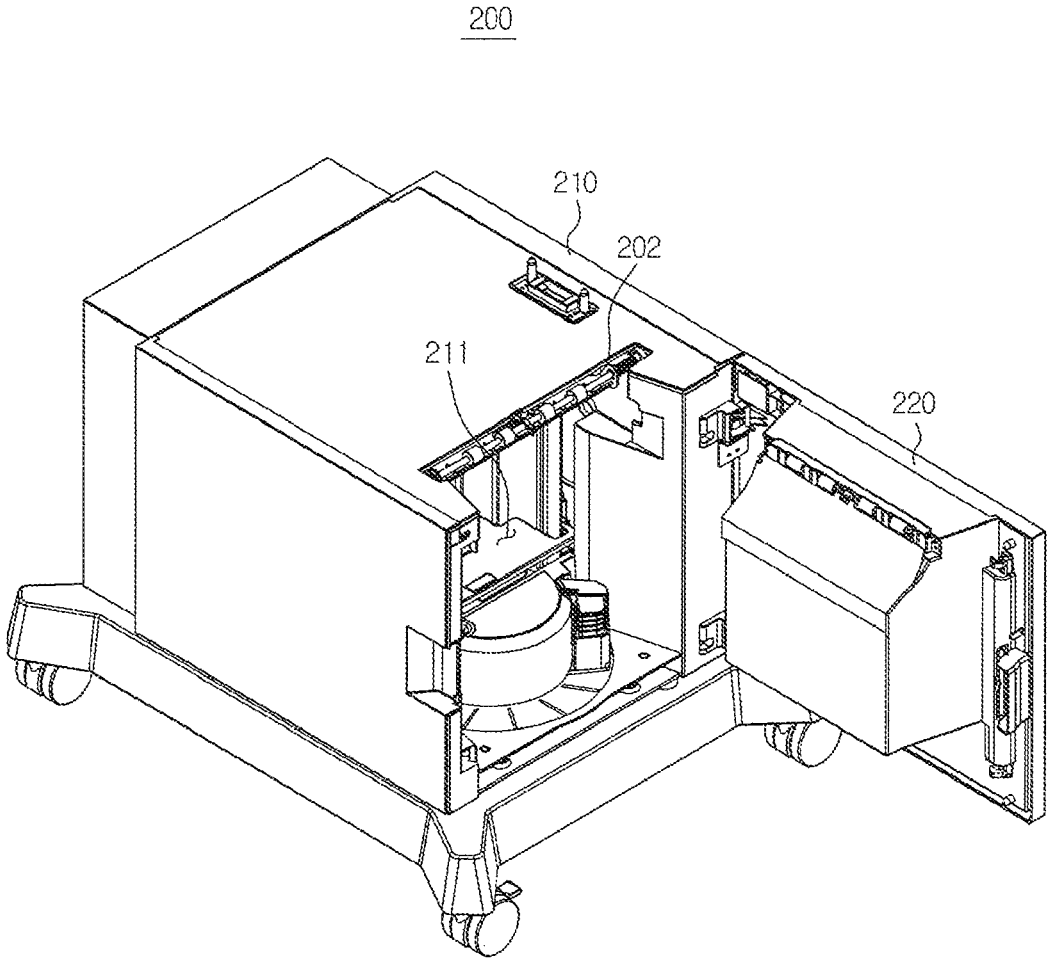
FIG. 2 is a perspective view of the paper supply unit according to an embodiment.

The paper supply unit 200, as shown in FIG. 2, may include a paper supply unit body 210 defining an external structure of the paper supply unit 200 and a door 220 rotatably provided at the open side of the body 210 to open or close the paper reservoir 211 that is defined in the body 210 to store paper therein. One side of the body 210 may be opened to expose the paper reservoir 211. A paper supply slot 202, through which paper is supplied to the image forming apparatus 100, may be provided in one side of an upper surface of the paper supply unit body 210.

Figure 3:
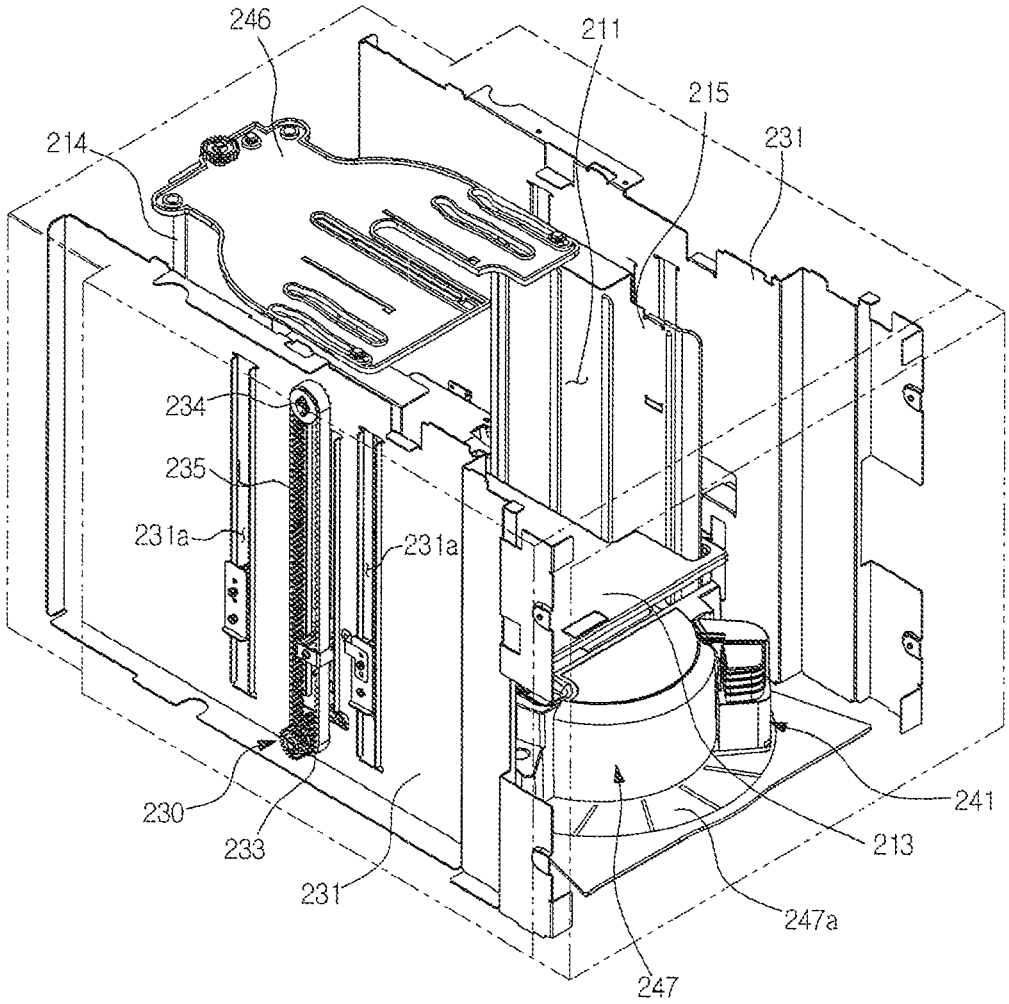
FIG. 3 is a perspective view illustrating an internal configuration of a paper supply unit according to an embodiment.
Figure 4:
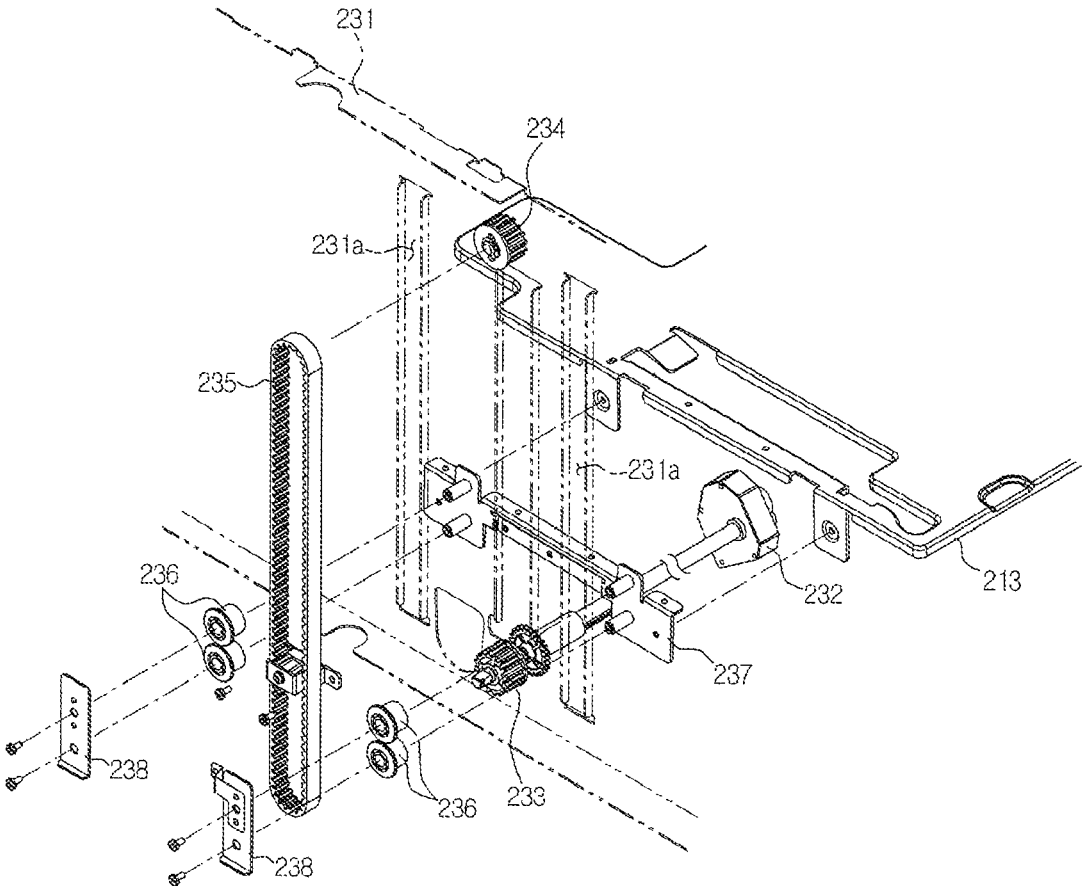
FIG. 4 is an exploded perspective view illustrating a lifting device provided in a paper supply unit according to an embodiment.

The paper supply unit body 210, as shown in FIGS. 3 and 4, may include therein a knock-up plate 213, on which paper may be received and stacked, and a lifting device 230 that may be configured to vertically move the knock-up plate 213.

The lifting device 230 according to an embodiment may include a lifting guide 231 vertically arranged lengthwise at either side of the knock-up plate 213 and configured to guide upward or downward movement of the knock-up plate 213, a lifting motor 232 provided at one side of the lifting guide 231 to generate the motional power, a first driving pulley 233 and a first driven pulley 234 vertically spaced apart from each other and configured to rotate upon receiving power from the lifting motor 232, and a lifting belt 235 that may be configured as a timing belt wound on the first driving pulley 233 and first driven pulley 234. The lifting belt 235 may be connected to the knock-up plate 213.

The lifting guide 231 may include vertically lengthwise lifting guiding slots 231*a*. Lifting guide rollers 236 may be rotatably coupled to the knock-up plate 213, and may be vertically movably fitted in the lifting guiding slots 231*a*. As the lifting belt 235 circulates around the first driving pulley 233 and first driven pulley 234 by the power generated from the lifting motor 232, the knock-up plate 213 may accordingly be moved upward or downward based on the circulating direction of the lifting belt 235.

To increase stability of the vertical movement of the knock-up plate 213, a pair of lifting guides 231 may be arranged at opposite sides of the knock-up plate 213. Each of the lifting guides 231 may be provided with a first driving pulley 233, first driven pulley 234 and lifting belt 235. Two first driving pulleys 233 may be connected to each other via a drive shaft (not shown) so as to be operated by the single lifting motor 232. In addition, each lifting guide 231 may be provided in opposite sides thereof with the vertically lengthwise lifting guiding slots 231*a*, and in turn, each of the lifting guiding slots 231*a* may be provided with a pair of the lifting guide rollers 236 rotatably coupled to the knock-up plate 213 and vertically movably arranged one above another. The pair of lifting guide rollers 236 arranged one above another may be supported by a supporting plate 238. In an embodiment, mounting brackets 237, to each of which the lifting belt 235 and a pair of the lifting guide rollers 236 are secured, are provided respectively at opposite sides of the knock-up plate 213. The knock-up plate 213 may be vertically movably coupled to the lifting guides 231 via the mounting brackets 237.

Figure 5:
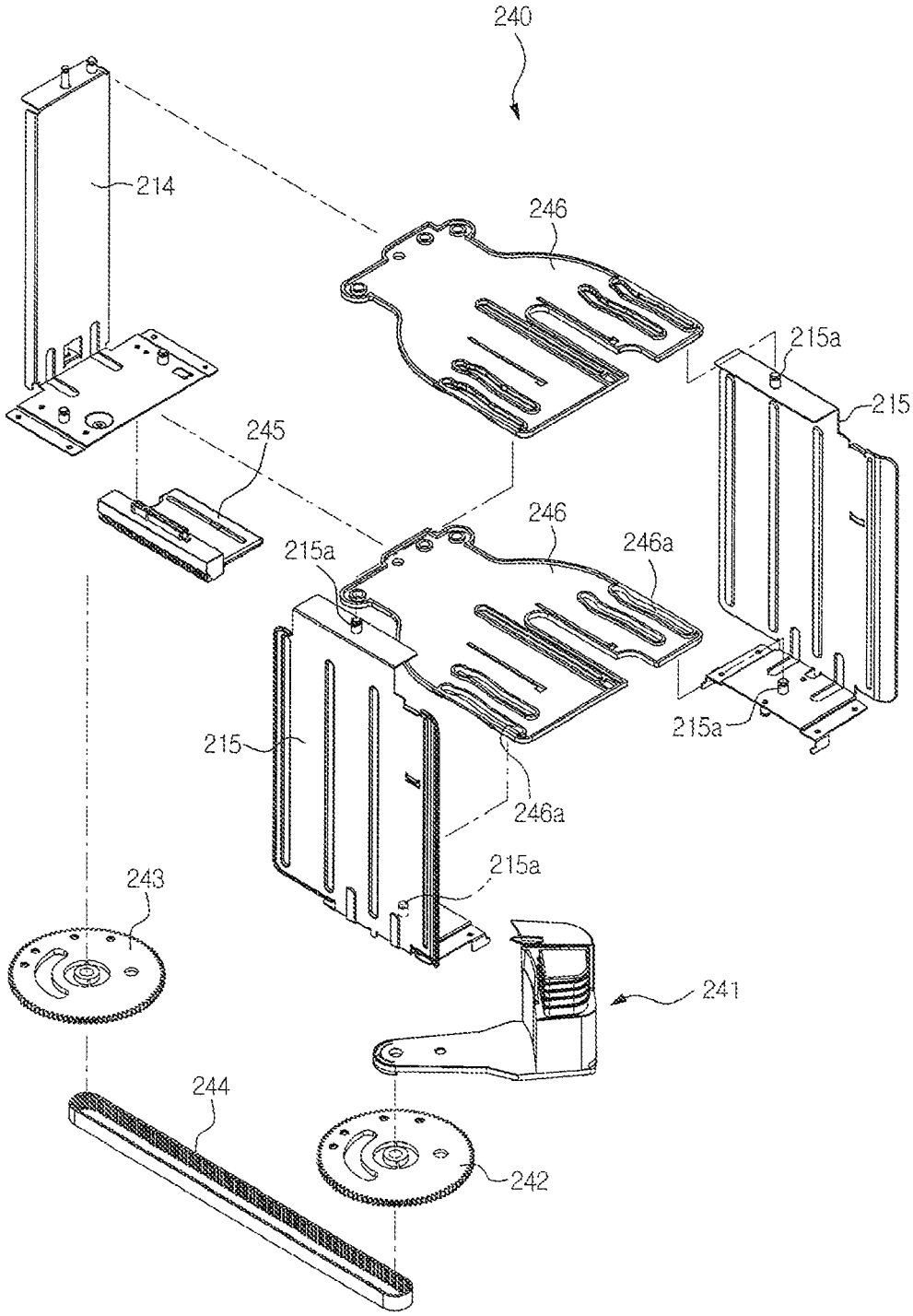
FIG. 5 is an exploded perspective view illustrating a supporting member drive device provided in a paper supply unit according to an embodiment.

The paper supply unit body 210, as shown in FIGS. 3 and 5, may further include therein a plurality of supporting members 214 and 215 movably provided inside the lifting device 230 and configured to support ends of paper stacked on the knock-up plate 213, as well as a supporting member drive device 240 configured to move the plurality of supporting members 214 and 215.

According to an embodiment, the supporting members 214 and 215 may include a single first supporting member 214 and a pair of second supporting members 215. The first supporting member 214 may be arranged and configured to support a longitudinal end of paper stacked on the knock-up plate 213, and may be configured to move forward or rearward in a longitudinal direction of the paper. The pair of second supporting members 215 may be arranged opposite each other to support both transversal ends of paper, and may be configured to move forward or rearward in a transversal direction of the paper stacked on the knock-up plate 213.

The supporting member drive device 240 may includes a movable handle 241 configured to move upon receiving an external force applied by a user so as to move the supporting members 214 and 215. In an embodiment, the handle 241 may be movable in a circumferential direction thereof when the external force is applied to the handle 241, thus serving to move the supporting members 214 and 215. In addition, the supporting member drive device 240 may include a second driving pulley 242, a second driven pulley 243, a rack gear 245, and linkage guides 246. The second driving pulley 242 may be connected to the handle 241, and may rotate with the handle 241 to allow the supporting members 214 and 215 to move through rotation of the handle 241. The second driven pulley 243 may rotate upon receiving a rotating force from the second driving pulley 242 through a moving belt 244 configured as a timing belt, for example. The rack gear 245 may be engaged with the second driven pulley 243, and may be coupled to the first supporting member 214. As the rack gear 245 is moved forward or rearward in the longitudinal direction of paper upon rotation of the second driven pulley 243, the first supporting member 214 is moved with the rack gear 245. The linkage guides 246 may allow the second supporting members 215 to be moved forward or rearward in the transversal direction of paper as the first supporting member 214 is moved forward or rearward in the longitudinal direction of paper.

The first supporting member 214 may be located at an end of the linkage guides 246 corresponding to the longitudinal end of paper, and thus may be moved in the longitudinal direction of paper together with the linkage guides 246. The pair of second supporting members 215 may be located at opposite ends of the linkage guides 246 corresponding to both the transversal ends of paper, and thus may be moved in the transversal direction of paper. The linkage guides 246 may include linkage guide slots 246*a* to guide movement of the second supporting members 215 in the transversal direction of paper, whereas the second supporting members 215 may include linkage guide protrusions 215*a* to be inserted into the corresponding linkage guide slots 246*a*. The linkage guide slots 246*a* extend in the longitudinal direction of paper to allow the second supporting members 215 to be moved in the transversal direction of paper as the first supporting member 214 is moved in the longitudinal direction of paper, and may also be curved in the transversal direction of paper. According to an embodiment, to provide stability for forward or rearward movement of the linkage guides 246, a pair of the linkage guides 246 may be connected respectively to upper and lower ends of the first supporting member 214, and, in turn, the upper and lower ends of the two second supporting members 215 may be movably connected to the respective linkage guides 246.

Figure 6:
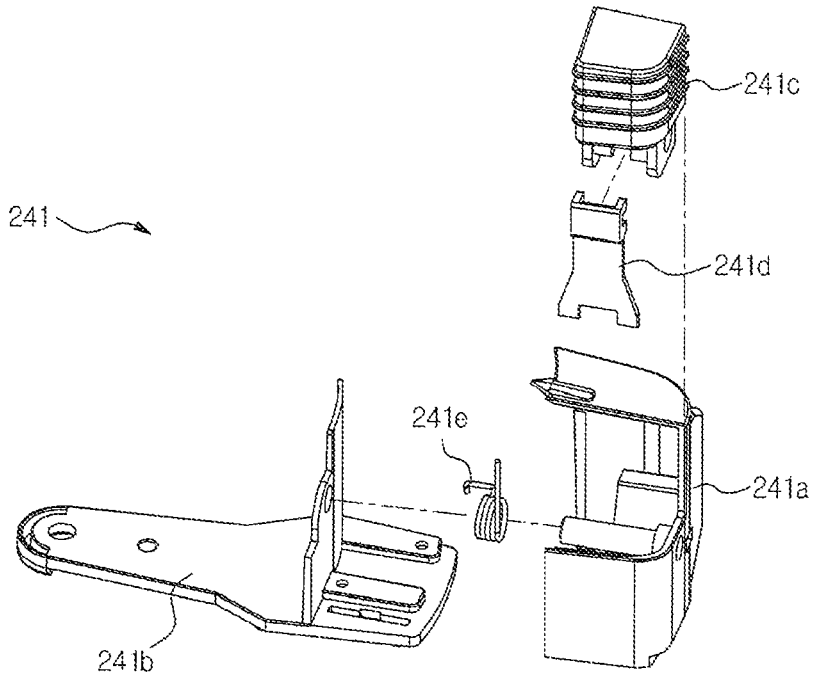
FIG. 6 is an exploded perspective view illustrating an installation configuration of a handle provided in a paper supply unit according to an embodiment.
Figure 6:
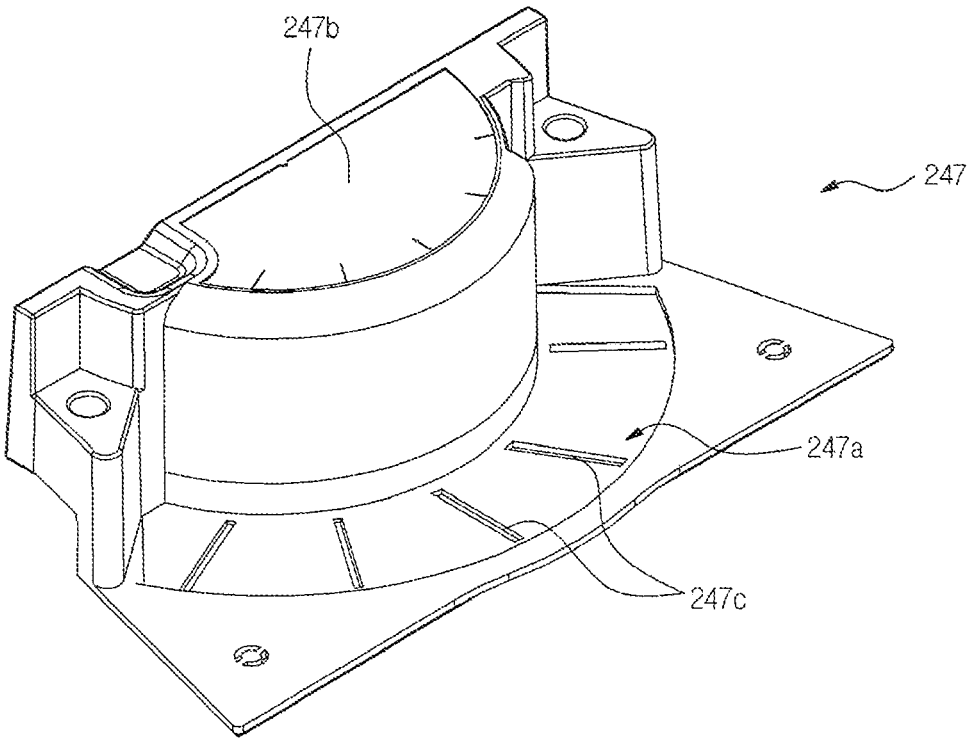

The supporting member drive device 240, as shown in FIG. 6, may further include a handle bracket 247 for installation of the handle 241. The handle bracket 247 may include a guide plane 247*a* configured to guide circumferential movement of the handle 241 rotatably placed thereon. The handle bracket may further include an indication plane 247*b* on which positions of the handle 241 on a per paper size basis are indicated. The guide plane 247*a* may be provided around a circumference of the indication plane 247*b*. The handle 241 may include a grip part 241*a* configured to receive an external force applied by a user and a hinge part 241*b* extending from the grip part 241*a* and rotatably coupled to the handle bracket 247. The indication plane 247*b* of the handle bracket 247 may be configured to cover a rotation path of the hinge part 241*b* of the handle 241.

The handle 241 may include a locking device to keep or otherwise secure the handle 241 at a predetermined position. Maintaining the handle 241 at a predetermined position using the locking device provided at the handle 241 may determine the positions of the supporting members 214 and 215 based on the position of the handle 241, and may thus keep the supporting members 214 and 215 at the determined positions without an additional mechanism, resulting in a simplified configuration of the paper supply unit 200.

In an embodiment, the locking device may include a latch 241*d* vertically movably provided at the handle 241, a lever 241*c* rotatably provided at the handle 241 and configured to move the latch 241*d* upward via rotation thereof, and a return spring 241*e* configured to elastically support the lever 241*c* so as to return the lever 241*c*, rotated by an external force, to an original position thereof. When the latch 241*d* is moved to protrude downward from the handle 241, a lower end of the latch 241*d* is inserted into one of a plurality of supporting grooves 247*c* indented in the guide plane 247*a*.

Figure 7:
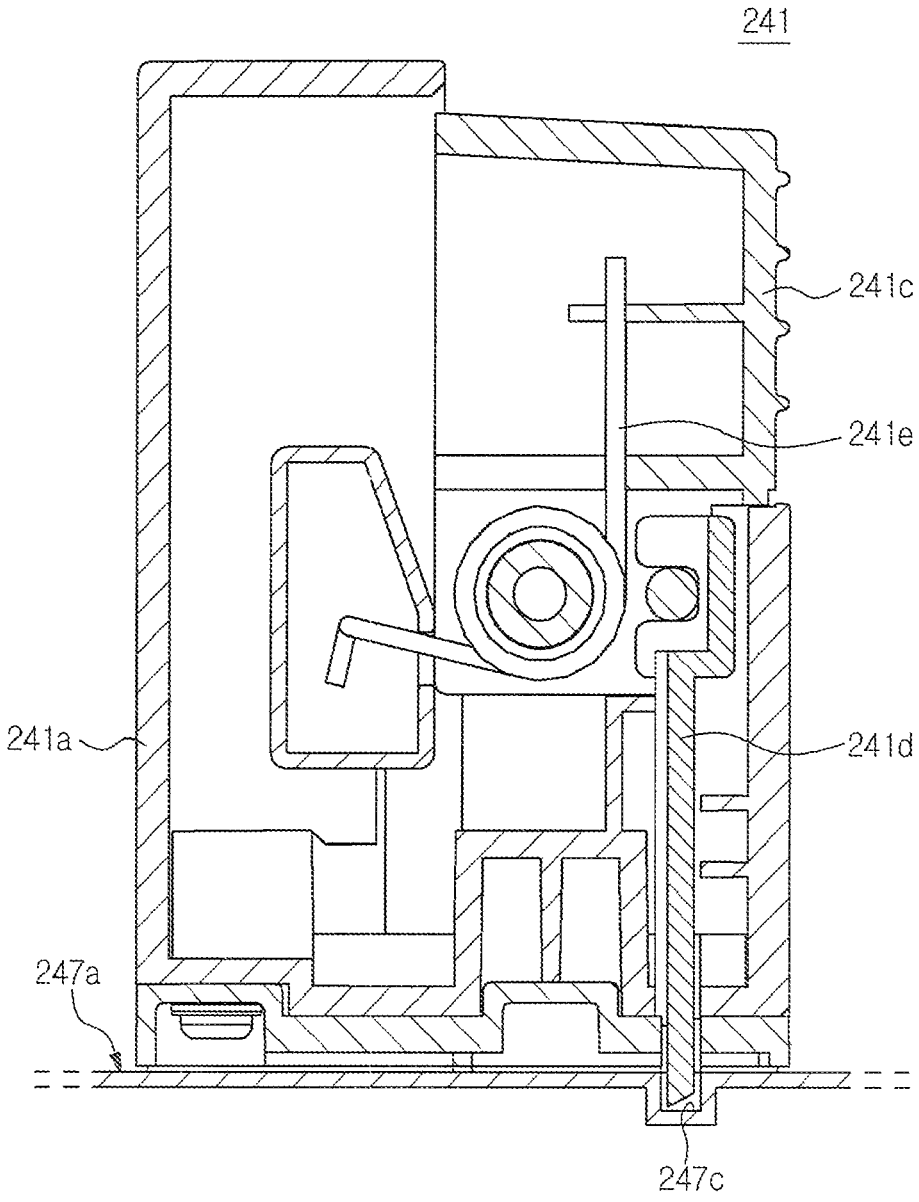
FIGS. 7 and 8 are sectional views illustrating operation of the handle provided in a paper supply unit according to an embodiment.
Figure 8:
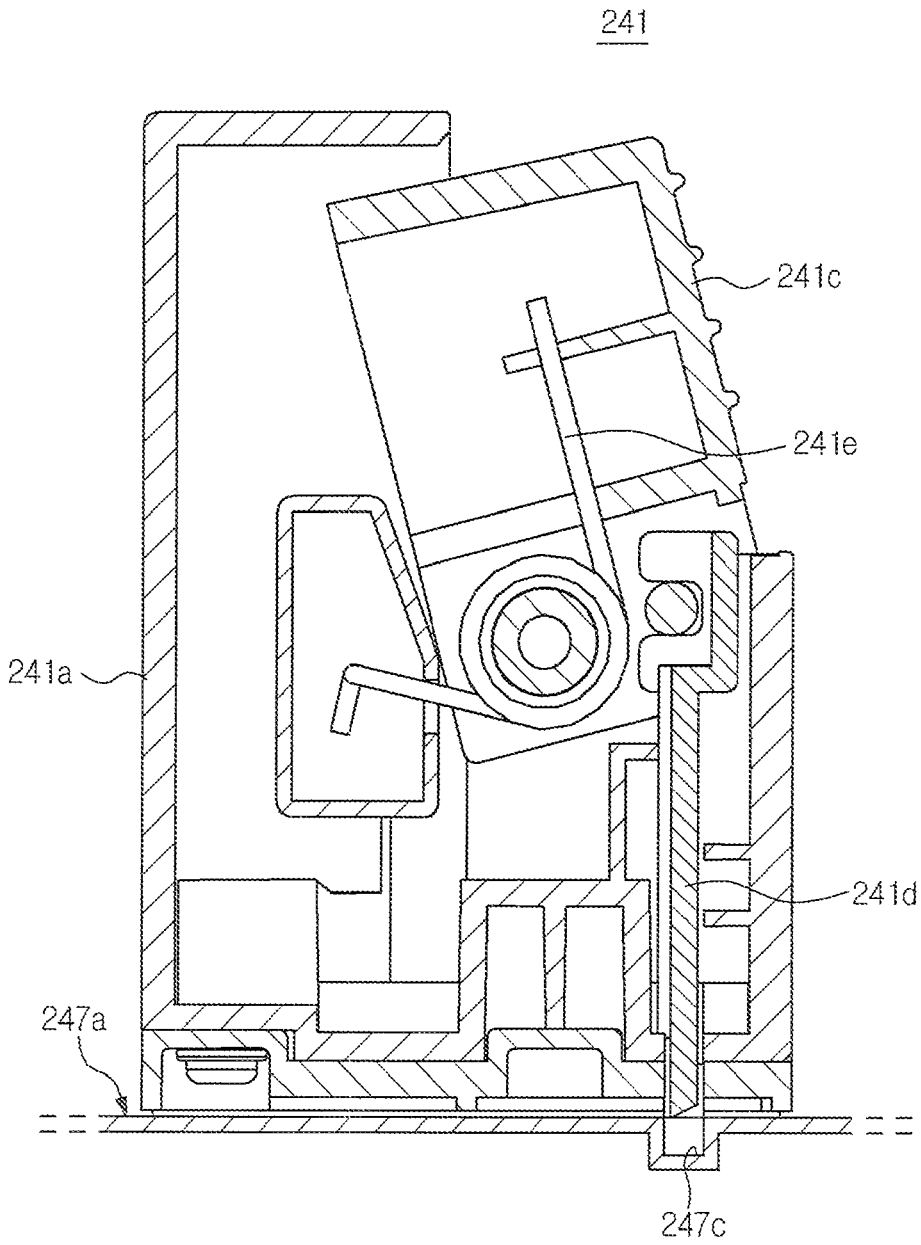

Accordingly, as shown in FIG. 7, the lower end of the latch 241*d* may be inserted and supported in a supporting groove 247*c* under the influence of an elastic force of the return spring 241*e*, and consequently, the handle 241 is kept at a predetermined position of the guide plane 247*a*. When the lever 241*c* is rotated upon receiving an external force, as shown in FIG. 8, the latch 241*d* is moved upward via the rotation of the lever 241*c*, causing the lower end of the latch 241*d* to be separated from the supporting groove 247*c*. Thereby, the handle 241 may be moved in a circumferential direction along the guide plane 247*a*. When the external force applied to the lever 241*c* is removed, as shown in FIG. 7, the lever 241*c* is rotated by an elastic restoration force of the return spring 241*e*, and is returned to an original position thereof. Thereby, the latch 241*d* is moved downward such that the lower end of the latch 241*d* is again inserted into and supported in the supporting groove 247*c*.

Figure 9:
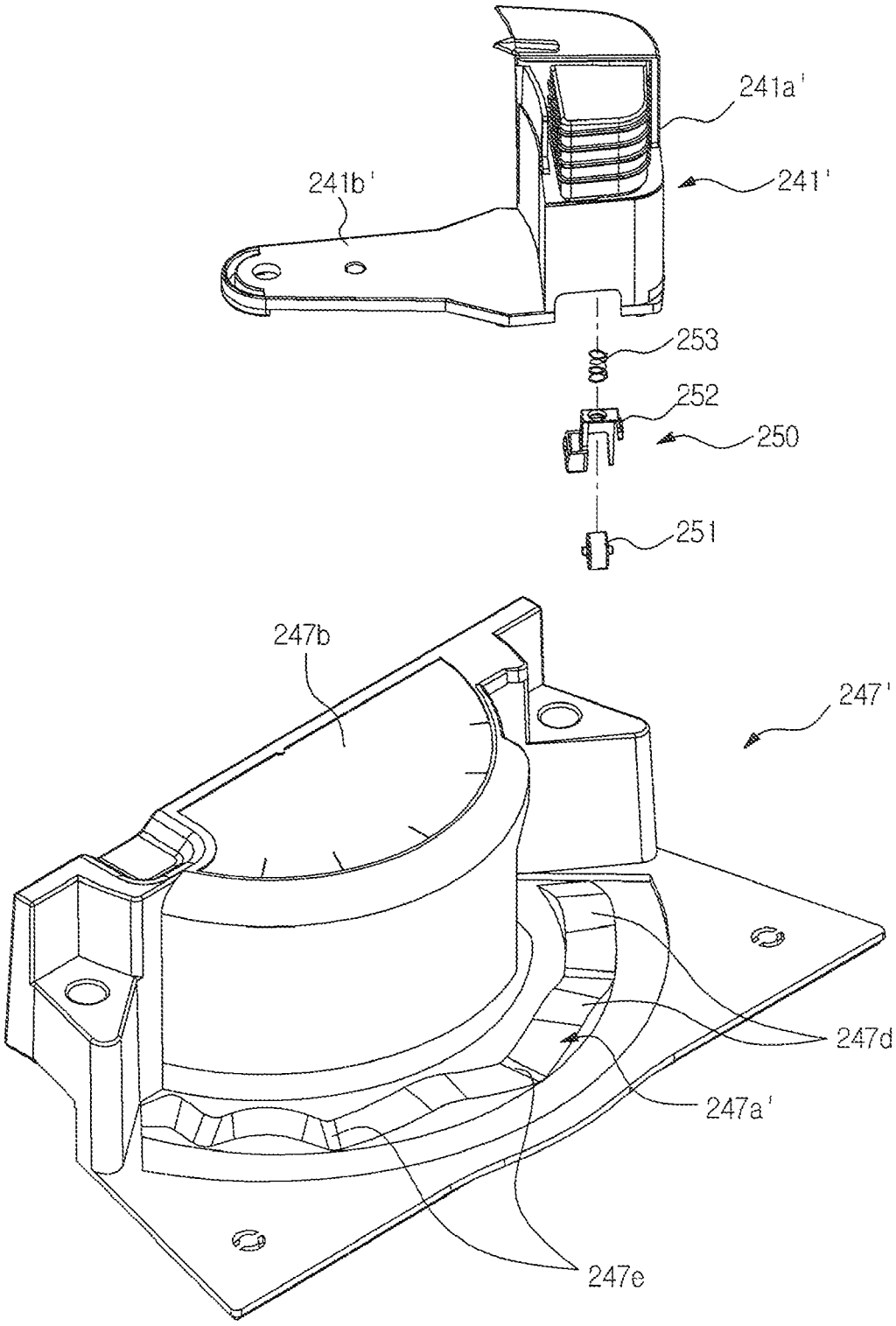
FIG. 9 is a perspective view of a handle and a handle bracket applied to a paper supply unit according to another embodiment.

FIG. 9 illustrates a handle and a locking device that may be utilized with the supply unit 200 according to another embodiment. A handle 241' and a handle bracket 247' are shown in FIG. 9.

The locking device may include an elastic supporting unit 250 provided at the handle 241' and configured to elastically support the handle 241' on a guide plane 247*a*' of the handle bracket 247' in a movable manner. The guide plane 247*a*' of the handle bracket 247' may include a plurality of alternately arranged peaks 247*d* and valleys 247*e*. The valleys 247*e* may be provided respectively at positions corresponding to the positions of the handle 241', indicated on the indication plane 247*b* on a per paper size basis.

Figure 10:
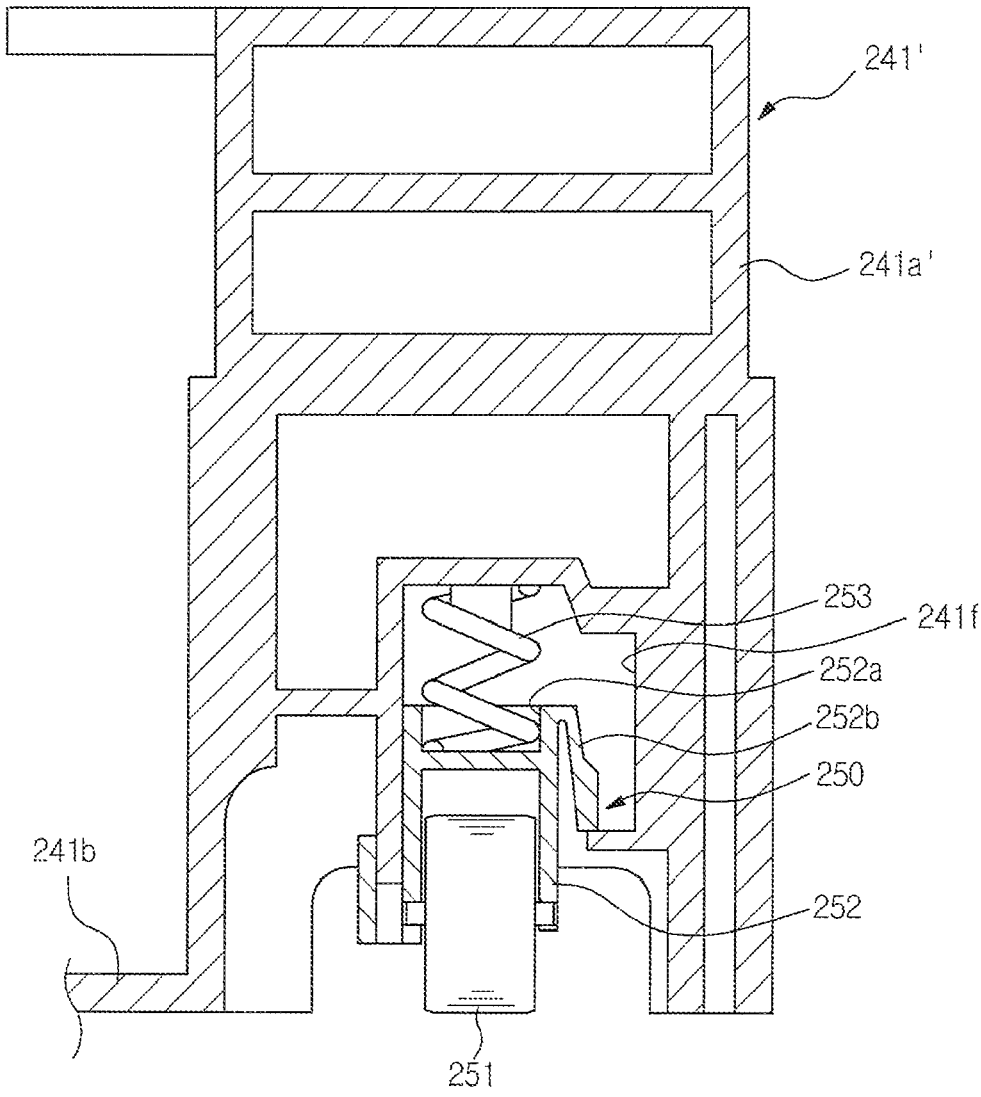
FIG. 10 is a sectional view illustrating a handle of the paper supply unit according to the embodiment shown in FIG. 9.

With reference to FIG. 10, a guide recess 241*f*, in which the elastic supporting unit 250 may be vertically movably provided, is illustrated. The guide recess 241*f* may be indented in the bottom of a grip part 241*a*' of the handle 241'. An entrance of the guide recess 241*f*, according to an embodiment, may be narrower than the remaining width of the guide recess 241*f* such that the elastic supporting unit 250 may be received and secured in the guide recess 241*f*.

The elastic supporting unit 250 may include a rolling member 251 in the form of, for example, a ball or roller movably supported on the guide plane 247*a*', an elastic supporting bracket 252 to which the rolling member 251 is rotatably mounted, and an elastic member 253 in the form of, for example, a coil spring having an upper end supported by the handle 241' and a lower end supported by the elastic supporting bracket 252. The elastic supporting bracket 252 may be indented in an upper surface thereof with an insertion recess 252*a* into which the lower end of the elastic member 253 may be inserted. A holder 252*b* may protrude from one side of the elastic supporting bracket 252, and may be caught by an entrance end of the guide recess 241*f* so as to prevent the elastic supporting unit 250 from being separated from the guide recess 241*f*.

In a state where the handle 241' is supported on the guide plane 247*a*' via the elastic supporting unit 250, when the user applies an external force to the handle 241' to position the handle 241' at an approximate position near the indicated position of a selected paper size, the handle 241' is moved along the guide plane 247*a*' via the rolling member 251 by an elastic restoration force of the elastic member 253 after the external force applied by the user is removed, thereby being moved to one of the valleys 247*e* of the guide plane 247*a*' corresponding to the indicated position. The handle 241' is kept at the valley 247*e* by the elastic restoration force of the elastic member 253 before the external force is again applied. Accordingly, it may be unnecessary for the user to position or situate the handle 241' at an accurate position, and thus, a simplified operation of the handle 241' may be possible.

As is apparent from the above description, in a paper supply unit according to the embodiments, a handle of the paper supply unit may be kept at a predetermined position via a locking device provided at the handle, and, consequently, the paper supporting members may be kept at predetermined positions. This results in a simplified configuration of the paper supply unit.

Further, the locking device applied to the paper supply unit may include an elastic supporting unit configured to elastically support the handle on a guide plane with alternately arranged peaks and valleys. With this configuration, even if the user positions the handle at an approximate position, the handle may be moved accurately to one of the valleys of the guide plane corresponding to the selected paper size under the influence of an elastic restoration force of the elastic supporting unit, resulting in a simplified operation of the handle.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A paper supply unit, comprising:

at least one paper supporting member movably arranged to support an end portion of paper;

a handle configured to receive an external force, the handle being moveable in response to the received external force, the at least one supporting members being moveable in association with a movement of the handle;

a guide plane defining an arc-shaped surface and configured to guide the movement of the handle, the guide plane including a plurality of supporting grooves spaced apart from each other; and a locking device provided at the handle and including a latch protruding downward from the handle in a vertically moveable manner, the latch including a lower end received by at least one supporting groove among the plurality of supporting grooves to maintain the handle at a predetermined position in relation to the guide plane.

2. The paper supply unit according to claim 1, wherein the locking device further comprises:

a lever configured to rotate upon receiving the external force from an original position at which the latch is received in the supporting groove into a released position at which the latch is positioned out of the supporting groove, and a return spring configured to elastically bias the lever toward a direction of returning to the original position.

3. The paper supply unit according to claim 1, wherein the locking device comprises an elastic supporting unit elastically supporting the handle on the guide plane in such a manner that the handle is moveable along the guide plane, and wherein the guide plane comprises a plurality of alternatingly arranged peaks and valleys.

4. The paper supply unit according to claim 3, wherein the elastic supporting unit comprises:

a rolling member rotatably supported on the guide plane;

an elastic supporting bracket to which the rolling member is rotatably mounted; and an elastic member having a lower end supported by the elastic supporting bracket and an upper end supported by the handle.

5. The paper supply unit according to claim 1, wherein the guide plane extends to define an arc, and wherein the handle is configured to move along the guide plane in a circumferential direction of the arc.

6. The paper supply unit according to claim 5, wherein the handle comprises:

a grip portion to which the external force is applied; and a hinge portion extending from the grip portion and pivotally coupled to the paper supply unit so as to allow a rotational movement of the handle.

7. The paper supply unit according to claim 6, further comprising:

a handle bracket comprising an indication plane, the indication plane being configured to cover an upper side of a rotation path of the hinge part and having thereon indication marks corresponding to a plurality of selectable paper sizes, wherein the guide plane is positioned radially outside of the indication plane with respect to the rotational movement of the handle.

8. The paper supply unit according to claim 1, further comprising:

a knock-up plate having a surface onto which the paper is to be received; and a lifting device configured to vertically move the knock-up plate.

9. The paper supply unit according to claim 8, wherein the lifting device comprises:

a lifting motor configured to produce a rotational force;

a driving pulley arranged to received the rotational force from the lifting motor and to thereby rotate;

a driven pulley arranged spaced apart from the driving pulley; and a lifting belt supported on the driving pulley and the driven pulley, the lift belt being coupled to the knock-up plate and being rotatable by a rotation of the driving pulley so as to cause the knock-up plate to move vertically.

10. The paper supply unit according to claim 1, wherein the at least one supporting member comprises a first supporting member configured to support a longitudinal end of the paper and a pair of second supporting members configured to support both transversal ends of the paper, and wherein the paper supply unit further comprises a supporting member drive device configured to move the first supporting member and the pair of second supporting members.

11. The paper supply unit according to claim 10, wherein the supporting member drive device comprises:

a driving pulley cooperatively coupled with the handle so as to be rotatable by the movement of the handle;

a driven pulley arranged spaced apart from the driving pulley;

a moving belt supported on the driving pulley and the driven pulley, the moving belt being rotatable by the driving pulley to thereby cause a rotation of the driven pulley; and a rack gear coupled to the first supporting member, the rack gear being movable linearly along a longitudinal direction by the rotation of the driven pulley.

12. The paper supply unit according to claim 11, wherein the supporting member drive device further comprises:

one or more linkage guides coupled to the first supporting member and configured to move the second supporting members in linkage with the first supporting member.

13. The paper supply unit according to claim 12, wherein each of the one or more linkage guides comprises one or more linkage guide slots extending generally along the longitudinal direction of the paper with at least one change of direction along a transversal direction of paper, and wherein each of the second supporting members comprises one or more linkage guide protrusions configured to be received into a respective corresponding one of the one or more linkage guide slots.

14. A paper supply unit, comprising:

a supporting member movably arranged to support an end portion of paper;

a guide plane defining an arc shaped surface, the guide plane including a plurality of supporting grooves arranged thereon and spaced apart from each other;

a handle configured to move in response to an external force in a circumferential direction of the arc shaped surface of the guide plane while being guided on the arc shaped surface, the supporting member being moveable in association with a movement of the handle; and a locking device provided at the handle and configured to maintain the handle at a predetermined position on the guide plane, wherein the locking device comprises:

a latch that protrudes downward from the handle in a vertically movable manner and that includes a lower end received by at least one supporting groove among the plurality of supported grooves;

a lever configured to rotate in response to receiving the external force, the lever rotating from an original position at which the latch is in a first position into a released position at which the latch has moved upward from the first position; and a return spring configured to elastically bias the lever toward a direction returning to the original position.

15. The paper supply unit according to claim 14, wherein the locking device comprises an elastic supporting unit elastically supporting the handle on the guide plane in such a manner that the handle is moveable along the guide plane, and wherein the guide plane comprises a plurality of alternatingly arranged peaks and valleys.

16. A paper supply apparatus for receiving therein a supply of paper of variable sizes, comprising:

a handle arranged to be accessible from outside of the paper supply apparatus so as to be capable of receiving an external force, the handle being configured to move in response to the external force selectively between at least a first handle position and a second handle position;

a guide plane defining an arc-shaped surface and configured to guide the movement of the handle, the guide plane including a plurality of supporting grooves spaced apart from each other;

a supporting member arranged to be movable in cooperation with a movement of the handle between at least a first support position and a second support position to support an end portion of paper of a first size and of a second size, respectively; and a locking mechanism arranged adjacent the handle and configured to maintain the handle at selected one of the first handle position and the second handle position, including a latch protruding downward from the handle in a vertically moveable manner, the latch including a lower end received by at least one supporting groove among the plurality of supporting grooves to maintain the handle at a predetermined position in relation to the guide plane.

17. The paper supply apparatus of claim 16, wherein the supporting member comprises:

a first supporting member configured to support a longitudinal end of paper; and a pair of second supporting members configured to support transversal ends of paper, wherein the paper supply apparatus further comprises:

a supporting member drive device configured to move the first supporting member and the pair of second supporting members, the supporting member drive device comprising:

a driving pulley coupled to the handle so as to be rotatable by the movement of the handle;

a driven pulley arranged to be spaced apart from the driving pulley;

a belt supported on the driving pulley and the driven pulley so as to be rotatable by a rotation of the driving pulley;

a rack gear configured to move along a longitudinal direction of paper in cooperation with the driven pulley, the first supporting member being coupled to the rack gear so as to move together with the rack gear; and one or more linkage guides arranged between the first supporting member and the second supporting members so as to cause the second supporting members to move along a transversal direction of paper in linkage with the first supporting member.

18. The paper supply apparatus of claim 16, further comprising:

a plurality of indication marks arranged adjacent the handle, each of the plurality of indication marks corresponding to a respective corresponding one of the variable sizes of paper.

* * * * *